US007342439B2

(12) United States Patent
Hsiao

(10) Patent No.: US 7,342,439 B2
(45) Date of Patent: Mar. 11, 2008

(54) CURRENT BIAS CIRCUIT AND CURRENT BIAS START-UP CIRCUIT THEREOF

(75) Inventor: Chun-Yang Hsiao, Tainan (TW)

(73) Assignee: DenMOS Technology Inc., Hsinchu (TW)

( * ) Notice: Subject to any disclaimer, the term of this patent is extended or adjusted under 35 U.S.C. 154(b) by 0 days.

(21) Appl. No.: 11/326,050

(22) Filed: Jan. 4, 2006

(65) Prior Publication Data

US 2007/0080743 A1 Apr. 12, 2007

(30) Foreign Application Priority Data

Oct. 6, 2005 (TW) ..... 94134930 A

(51) Int. Cl.
*G05F 1/10* (2006.01)
*G05F 3/02* (2006.01)

(52) U.S. Cl. ..... 327/538; 327/543

(58) Field of Classification Search ..... 327/541, 327/543; 323/315, 901
See application file for complete search history.

(56) References Cited

U.S. PATENT DOCUMENTS

| | | | | |
|---|---|---|---|---|
| 4,906,871 | A * | 3/1990 | Iida | 326/66 |
| 5,155,384 | A * | 10/1992 | Ruetz | 327/537 |
| 5,243,231 | A | 9/1993 | Baik | 327/544 |
| 5,559,425 | A * | 9/1996 | Allman | 323/315 |
| 6,031,365 | A * | 2/2000 | Sharpe-Geisler | 323/313 |
| 6,111,397 | A | 8/2000 | Leung | 323/315 |
| 6,351,111 | B1 * | 2/2002 | Laraia | 323/315 |
| 2002/0089371 | A1 * | 7/2002 | Goutti et al. | 327/538 |
| 2004/0027191 | A1 * | 2/2004 | Rashid et al. | 327/538 |

* cited by examiner

*Primary Examiner*—Tuan T. Lam
(74) *Attorney, Agent, or Firm*—J.C. Patents

(57) ABSTRACT

A current bias circuit and a current bias start-up circuit thereof are disclosed. The bias start-up circuit supplies a compensation current to the bias circuit to compensate the leakage current of the current bias circuit during activation and turns off the compensation current after start-up. Accordingly, the bias start-up circuit could compensate the leakage current of the current bias circuit and the bias start-up circuit could reduce the power consumption.

12 Claims, 4 Drawing Sheets

CURRENT BIAS CIRCUIT AND CURRENT BIAS START-UP CIRCUIT THEREOF

CROSS-REFERENCE TO RELATED APPLICATION

This application claims the priority benefit of Taiwan application serial no. 94134930, filed on Oct. 6, 2005. All disclosure of the Taiwan application is incorporated herein by reference.

BACKGROUND OF THE INVENTION

1. Field of Invention

The present invention relates to an analog circuit, and, more particularly, to a current bias circuit and a current bias start-up circuit thereof.

2. Description of Related Art

Generally speaking, a current mirror serves as a bias circuit in an analog circuit. A start-up circuit is needed by this kind of bias circuit to ensure the proper operation of the circuit.

FIG. 1 is a diagram of a conventional bias circuit. Referring to FIG. 1, the conventional bias circuit includes a current bias circuit 10 and a bias start-up circuit 11 wherein the current bias circuit 10 includes P-type transistors MP101 and MP102, N-type transistors MN101, MN102, MN103, and MN104, diodes D101, D102, and D103. The bias start-up circuit 11 includes diodes D111, D112, and a resistor R111.

During activation, the bias start-up circuit 11 supplies the current $I_{PU}$ passing through the diodes D111 and D112 to the current mirror formed of the N-type transistors MN103 and MN104 in the current bias circuit 10 to turn on the bias circuit. The resistor R111 is used for limiting the current $I_{PU}$.

Generally speaking, there is a working range, e.g. from 7V to 15V, for the power supply voltage of an integrated circuit. Referring to the bias start-up circuit 11 in FIG. 1, the start-up circuit works with lower current when the power supply voltage is working at 7V. When the power supply voltage is working at 15V, the working current of the start-up circuit may increase 2 times, which results in power consumption in the integrated circuit.

FIG. 2 is a diagram of another conventional bias circuit. Referring to FIG. 2, the bias circuit includes a current bias circuit 20 and a bias start-up circuit 21 wherein the current bias circuit 20 includes P-type transistors MP201 and MP202, N-type transistors MN201, MN202, MN203, and MN204, diodes D201, D202, and D203. The bias start-up circuit 21 includes an inverter INV21 and an N-type transistor MN211. The inverter INV21 comprises a P-type transistor MP212 and an N-type transistor MN213.

During activation, the input voltage level of the input terminal of the inverter INV 21, the gates of the P-type transistor MP212 and the N-type transistor MN213, is at low voltage level, so that the output terminal of the inverter INV21, which is the nodes where the sources/drains of the P-type transistor MP212 and the N-type transistor MN213 are coupled to each other, outputs high voltage level to the gate of the N-type transistor MN211 to turn on the N-type transistor MN211. Since the N-type transistor is turned on, the voltage level at the node where the gates of the P-type transistors MP201 and MP202 are coupled is pulled down. The P-type transistors MP201 and MP202 are turned on forcedly to activate the bias circuit.

Upon completion of activation, the input terminal of the inverter INV21 receives high voltage level so that the node where the sources/drains of the P-type transistor MP212 and the N-type transistor MN213 are coupled, outputs low voltage level to the gate of the N-type transistor MN211. Additionally, the gate of the N-type transistor MN211 is turned off. The advantage of the bias start-up circuit is that no additional power consumption upon completion of activation.

However, the circuit discussed above does not provide much solution for leakage current. Generally speaking, an integrated circuit produces leakage current when it is illuminated. The circuit in FIG. 2 cannot be turned off when the PN Junction formed of the N-type transistors MN201 and MN203 produces leakage current.

SUMMARY OF THE INVENTION

Accordingly, the present invention is directed to provide a current bias start-up circuit for turning on a current bias circuit.

According to another aspect of the present invention, a current bias circuit, which can be turned on even when there is leakage current in the circuit, is provided.

The present invention provides a current bias start-up circuit for turning on a current source including N current mirrors, each current mirror includes a first transistor and a second transistor, the drain of the first transistor is coupled to the gate of the first transistor, the gate of the second transistor is coupled to the gate of the first transistor, the sources of the first transistor and the second transistor of the first current mirror are coupled to a first voltage. The current bias start-up circuit includes a third transistor, a resistor, and a fourth transistor. The gate of the third transistor is coupled to the gate of the second transistor of the first current mirror, and the first source/drain of the third transistor is coupled to the first voltage. The first terminal of the resistor is coupled to the second source/drain of the third transistor, and the second terminal of the resistor is coupled to a second voltage. The gate of the fourth transistor is coupled to the first terminal of the resistor, the first source/drain of the fourth transistor is coupled to the first voltage, the second source/drain of the fourth transistor is coupled to the gate of the first transistor of the $K^{th}$ current mirror, wherein N and K are natural numbers and $2<K<N$.

According to the current bias start-up circuit in an exemplary embodiment of the present invention, the resistor includes a fifth transistor. The gate of the fifth transistor is coupled to the first voltage, the first source/drain of the fifth transistor is the first terminal of the resistor, and the second source/drain of the fifth transistor is another terminal of the resistor.

The present invention provides a current bias circuit including a current source, a third transistor, a resistor, and a fourth transistor. The current source includes N current mirrors, and each current mirror includes a first transistor and a second transistor. The drain of the first transistor is coupled to the gate of the first transistor. The gate of the second transistor is coupled to the gate of the first transistor. The sources of the first transistor and the second transistor of the first current mirror are coupled to the first voltage. The gate of the third transistor is coupled to the gate of the second transistor of the first current mirror, and the first source/drain of the third transistor is coupled to the first voltage. The first terminal of the resistor is coupled to the second source/drain of the third transistor, and the second terminal of the resistor is coupled to the second voltage. The gate of the fourth transistor is coupled to the first terminal of the resistor, the first source/drain of the fourth transistor is coupled to the first voltage, the second source/drain of the fourth transistor is coupled to the gate of the first transistor of the $K^{th}$ current mirror, wherein N and K are natural numbers and 2<K<N.

According to the current bias circuit in an exemplary embodiment of the present invention, the aforementioned resistor includes a fifth transistor, the gate of the fifth transistor is coupled to the first voltage, the first source/drain of the fifth transistor is the first terminal of the resistor, and the second source/drain of the fifth transistor is another terminal of the resistor.

Since the present invention adopts the structure of supplying a current to the bias circuit to compensate the leakage current during activation and to turn off the current upon completion of activation, the circuit can not only compensate the leakage current, but also reduce power consumption.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
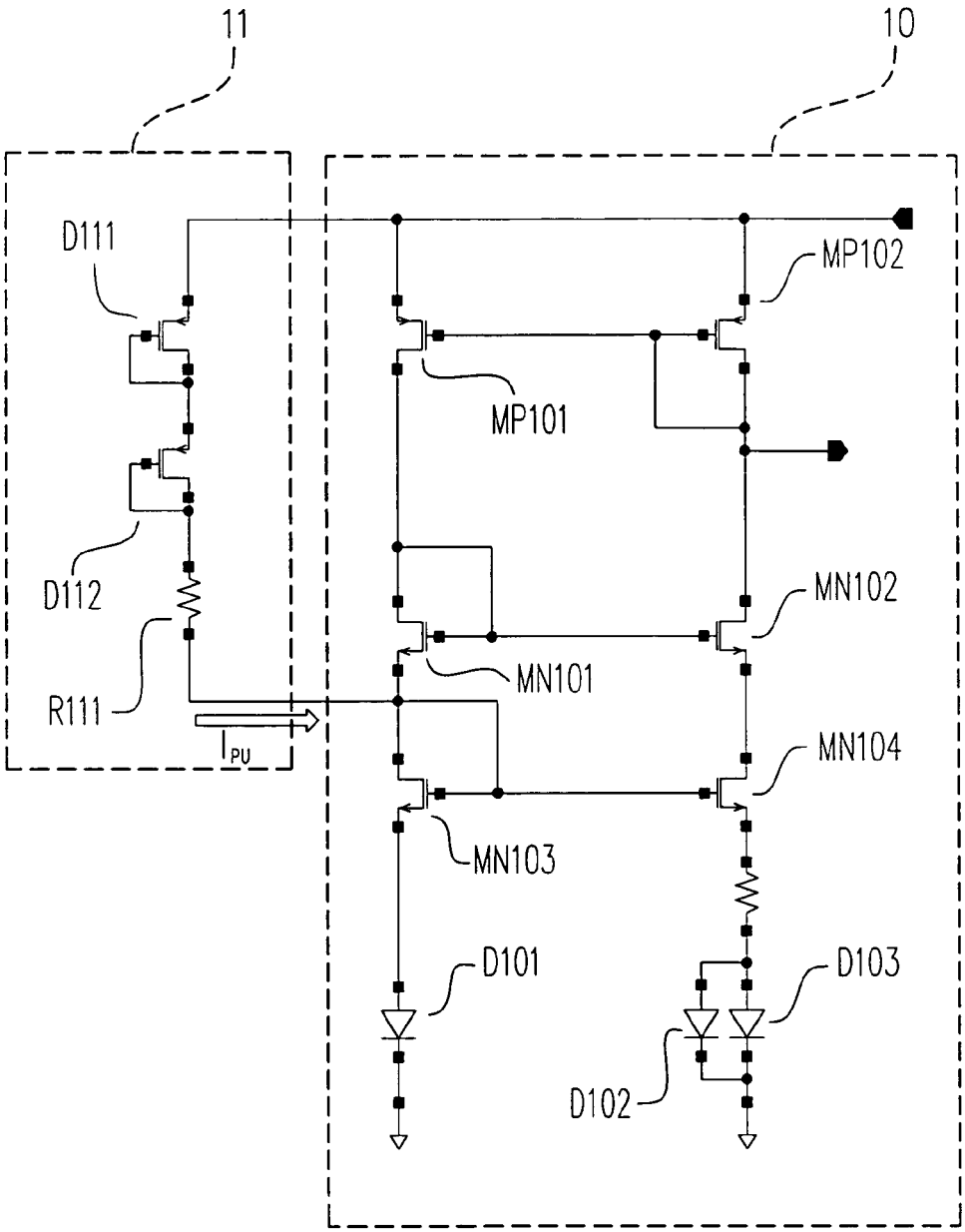
FIG. 1 (PRIOR ART)
FIG. 1 is a diagram of a conventional bias circuit.
Figure 2:
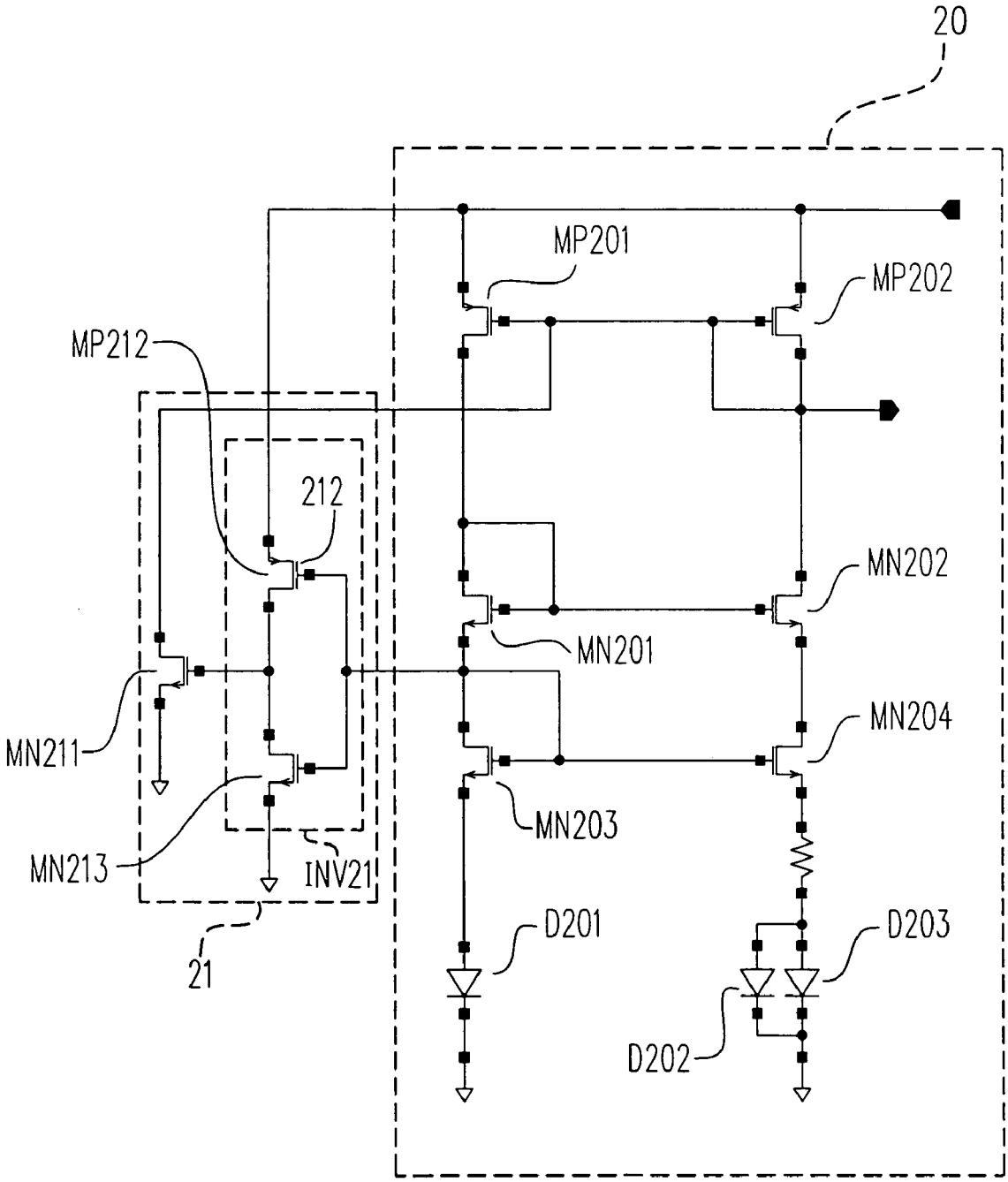
FIG. 2 (PRIOR ART)
FIG. 2 is a diagram of another conventional bias circuit.
Figure 3:
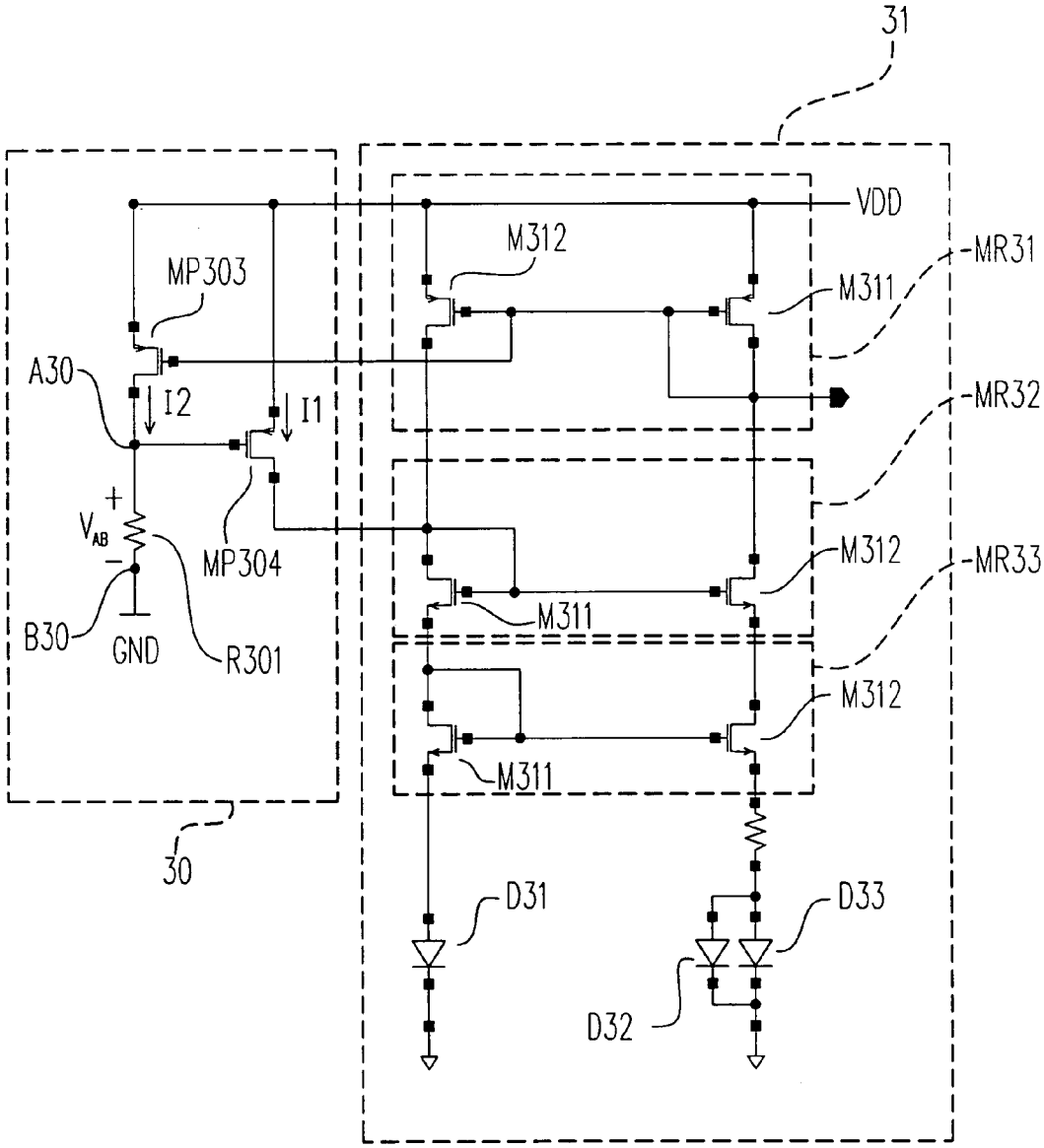
FIG. 3 is a diagram of a current bias circuit according to an embodiment of the present invention.

FIG. 3 is a diagram of a current bias circuit according to an embodiment of the present invention. Referring to FIG. 3, the current bias circuit includes a bias current source 31 and a bias start-up circuit 30 according to the embodiment of the present invention. The bias current source 31 includes 3 current mirrors MR31 (an embodiment, not intended to limit the present application), MR32, and MR33, and diodes D31, D32, and D33 and each current mirror includes a first transistor M311 and a second transistor M312. The drain of the first transistor M311 is coupled to the gate of the first transistor M311. The gate of the second transistor M312 is coupled to the gate of the first transistor M311. The sources of the first transistor M311 and the second transistor M312 of the first current mirror are coupled to a first voltage, such as VDD.

The bias start-up circuit 30 includes a third transistor MP303, an impedance device in which a resistor R301 is used as an example in the present embodiment, and a fourth transistor MP304. The gate of the third transistor MP303 is coupled to the gate of the second transistor M312 of the first current mirror MR31, and the first source/drain of the third transistor MP303 is coupled to the first voltage VDD. The first terminal A30 of the resistor R301 is coupled to the second source/drain of the third transistor MP303, and the second terminal B30 of the resistor R301 is coupled to the second voltage, such as the ground voltage GND. The gate of the fourth transistor MP304 is coupled to the first terminal A30 of the resistor R301, the first source/drain of the fourth transistor MP304 is coupled to the first voltage VDD, and the second source/drain of the fourth transistor MP304 is coupled to the gate of the first transistor M311 of the second current mirror.

In the present embodiment, the second source/drain of the fourth transistor MP304 is coupled to the gate of the first transistor M311 of the second current mirror. However, it should be understood by those skilled in the art that the second source/drain of the fourth transistor MP304 can be coupled to the gate of the first transistor M311 of the third current mirror. Accordingly, the present invention is not limited to the coupling structure discussed above. In addition, the third transistor MP303 and the fourth transistor MP304 of the present embodiment are embodied with P-type metal-oxide-semiconductor field-effect transistors, and the first transistor M311 and the second transistor M312 of the first current mirror MR31 are embodied with P-type metal-oxide-semiconductor field-effect transistors.

Upon activating the circuit, the gate voltage of the first transistor M311 of the first current mirror MR31 approaches to VDD to turn off the third transistor MP303. Because the second terminal B30 of the resistor R301 is coupled to the ground voltage GND, the fourth transistor MP304 is turned on and the current I1 is supplied from the power supply VDD to the current mirror MR32 of the bias current source 31 through the fourth transistor MP304. In addition, the current I1 can be used for compensating the leakage current of the bias current source 31, such as the leakage current of the second current mirror and the third current mirror caused by diodes D31, D32, and D33.

Upon completion of activation, the voltage received by the gate of the third transistor MP303 drops slightly to turn on the third transistor MP303. Since the third transistor MP303 is turned on, the current I2 passes through the resistor R301, which results in a voltage drop $V_{AB}$. The voltage drop $V_{AB}$ will turn off the fourth transistor; therefore, no additional power consumption upon completion of activation.

Figure 4:
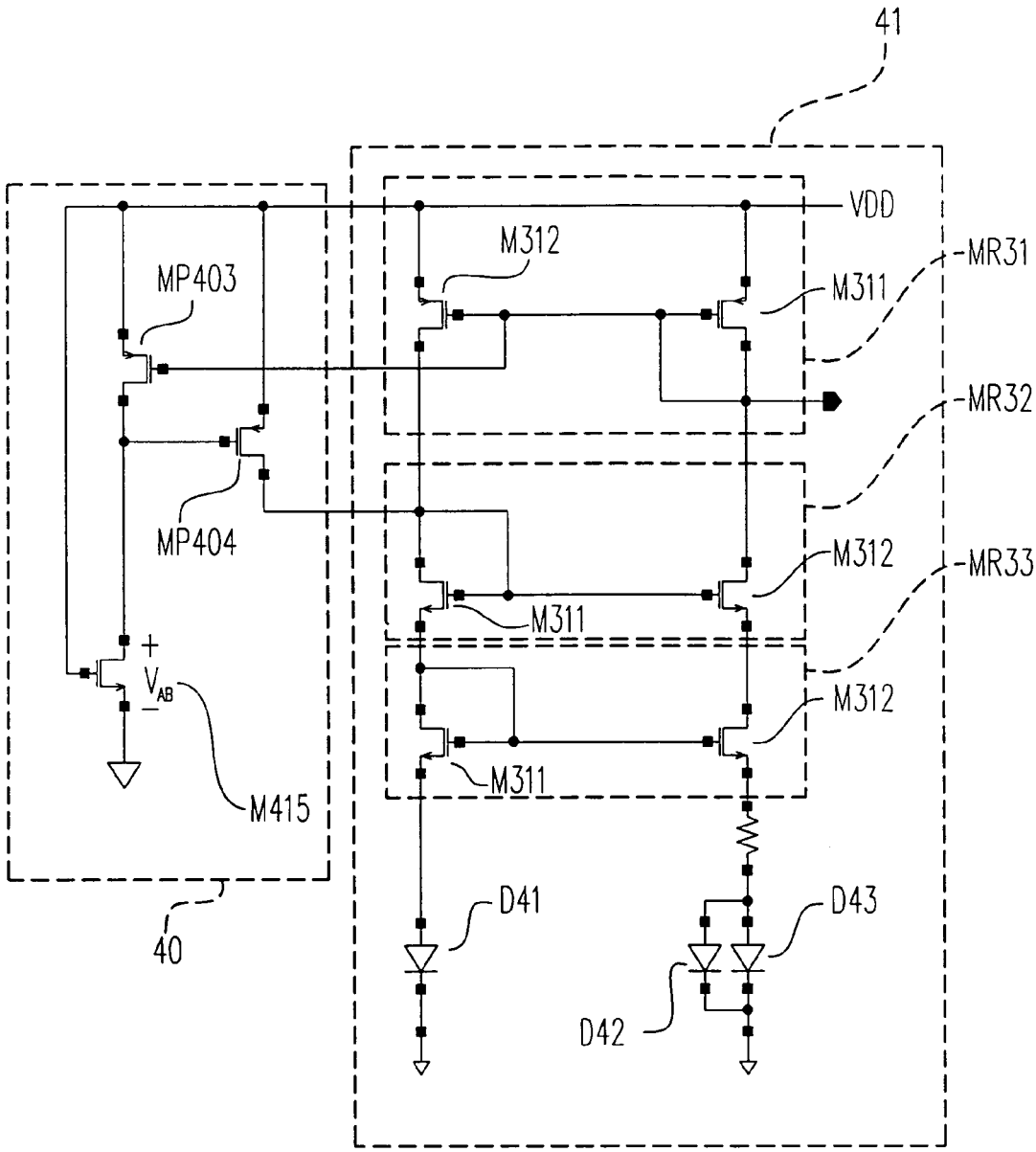
FIG. 4 is a diagram of a current bias circuit according to another embodiment of the present invention.

FIG. 4 is a diagram of a current bias circuit according to another embodiment of the present invention. The difference between FIG. 4 and FIG. 3 is that the resistor R301 in FIG. 3 is disposed as the impedance device while the impedance device according to embodiment of FIG. 4 is a fifth transistor M415. Additionally, in FIG. 3, the fourth transistor MP304 is coupled to the second current mirror MR32 while the fourth transistor MP404 in FIG. 4 is be coupled to the third current mirror MR43. The gate of the fifth transistor M415 is coupled to the first voltage VDD, the first source/drain of the fifth transistor M415 is the first terminal A30 of the resistor R301 in FIG. 3, and the second source/drain of the fifth transistor is the second terminal B30 of the resistor R301 in FIG. 3.

The way the current bias activating the circuit according to the embodiment in FIG. 4 is similar to that of FIG. 3. Upon activating the circuit, the leakage current of the bias current source 41, such as the leakage current of the third current mirror produced by diodes D41, D42, and D43, is compensated by the current I passing through the fourth transistor MP404. Upon completion of activation, the third transistor MP403 is turned on to produce a voltage drop $V_{AB}$ on the fifth transistor M415 to turn off the fourth transistor MP404, which is similar to that in FIG. 3.

In view of the foregoing, according to the embodiments of the present invention, during activation a current is supplied to the bias circuit to compensate for the leakage current and the current is turned off upon completion of activation. Accordingly, the circuit can not only compensate for the leakage current, but also reduce power consumption.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A current bias start-up circuit, which is used for activating a current bias circuit, wherein the current bias circuit includes N current mirrors, each current mirror includes a first transistor and a second transistor, the drain of the first transistor is coupled to the gate of the first transistor, the gate of the second transistor is coupled to the gate of the first transistor, and the sources of the first transistor and the second transistor of a first current mirror of the N current mirrors coupled to a first voltage, the current bias start-up circuit comprising:

a third transistor, having its gate coupled to the gates of the first transistor and the second transistor of the first current mirror, and its first source/drain coupled to the first voltage;

an impedance device, including a first terminal and a second terminal, wherein the first terminal is coupled to a second source/drain of the third transistor and the second terminal is coupled to a second voltage; and a fourth transistor, having its gate coupled to the first terminal of the impedance device, its first source/drain coupled to the first voltage, its second source/drain coupled to the gate of the first transistor of a Kth current mirror of the N current mirrors, wherein the source/drain of the first transistor of the first current mirror of the N current mirrors is directly coupled to the source/drain of the first transistor of the Kth current mirror of the N current mirrors and the source/drain of the second transistor of the first current mirror of the N current mirrors is directly coupled to the source/drain of the second transistor of the Kth current mirror of the N current mirrors, wherein N and K are natural numbers and $2 \leqq K < N$, wherein the impedance device is a fifth transistor having its gate coupled to the first voltage, its first source/drain being the first terminal of the impedance device, and its second source/drain being the second terminal of the impedance device, and wherein the first voltage is greater than the second voltage.

2. The current bias start-up circuit according to claim 1, wherein the fifth transistor of the impedance device forms a resistor.

3. The current bias start-up circuit according to claim 1, wherein the fifth transistor is an N-type metal-oxide-semiconductor field-effect transistor.

4. The current bias start-up circuit according to claim 1, wherein the second voltage is ground voltage.

5. The current bias start-up circuit according to claim 1, wherein the first transistor and the second transistor of the first current mirror are P-type metal-oxide-semiconductor field-effect transistors.

6. The current bias start-up circuit according to claim 1, wherein the third transistor and the fourth transistor are P-type metal-oxide-semiconductor field-effect transistors.

7. A current bias circuit, comprising:

a bias current source, including N current mirrors, wherein each current mirror includes a first transistor and a second transistor, the drain of the first transistor is coupled to the gate of the first transistor, the gate of the second transistor is coupled to the gate of the first transistor, and the sources of the first transistor and the second transistor of a first current mirror of the N current mirrors;

a third transistor, having its gate coupled to the gates of the first transistor and the second transistor of the first current mirror and its source/drain coupled to the first voltage;

an impedance device, including a first terminal and a second terminal, wherein the first terminal is coupled to the second source/drain of the third transistor, and the second terminal is coupled to a second voltage; and a fourth transistor, having its gate coupled to the first terminal of the impedance device, its first source/drain coupled to the first voltage, and its second source/drain coupled to the gate of the first transistor of a Kth current mirror of the N current mirrors, wherein the source/drain of the first transistor of the first current mirror of the N current mirrors is directly coupled to the source/drain of the first transistor of the Kth current mirror of the N current mirrors and the source/drain of the second transistor of the first current mirror of the N current mirrors is directly coupled to the source/drain of the second transistor of the Kth current mirror of the N current mirrors, wherein N and K are natural numbers and $2 \leqq K < N$, wherein the impedance device is a fifth transistor having its gate coupled to the first voltage, its first source/drain coupled to the first terminal of the impedance device, and its second source/drain coupled to the second terminal of the impedance device, and wherein the first voltage is greater than the second voltage.

8. The current bias circuit according to claim 7, wherein the fifth transistor is an N-type metal-oxide-semiconductor field-effect transistor.

9. The current bias circuit according to claim 7, wherein the impedance device is a resistor.

10. The current bias circuit as claimed in claim 7, wherein the second voltage is ground voltage.

11. The current bias circuit according to claim 7, wherein the first transistor and the second transistor of the first current mirror are P-type metal-oxide-semiconductor field-effect transistors.

12. The current bias circuit according to claim 7, wherein the third transistor and the fourth transistor are P-type metal-oxide-semiconductor field-effect transistors.

* * * * *